US011336021B2

(12) United States Patent
Huang

(10) Patent No.: US 11,336,021 B2
(45) Date of Patent: May 17, 2022

(54) DIPOLE ANTENNA

(71) Applicant: Wistron NeWeb Corp., Hsinchu (TW)

(72) Inventor: Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 42 days.

(21) Appl. No.: 17/014,459

(22) Filed: Sep. 8, 2020

(65) Prior Publication Data

US 2021/0328352 A1 Oct. 21, 2021

(30) Foreign Application Priority Data

Apr. 17, 2020 (TW) ..... 109112933

(51) Int. Cl.

| | |
|---|---|
| ***H01Q 9/16*** | (2006.01) |
| ***H01Q 9/44*** | (2006.01) |
| ***H01Q 1/24*** | (2006.01) |
| ***H01Q 5/35*** | (2015.01) |

(52) U.S. Cl.
CPC ..... *H01Q 9/44* (2013.01); *H01Q 1/243* (2013.01); *H01Q 5/35* (2015.01)

(58) Field of Classification Search
CPC ..... H01Q 9/44; H01Q 1/243; H01Q 5/35
See application file for complete search history.

(56) References Cited

U.S. PATENT DOCUMENTS

2002/0084937 A1* 7/2002 Shinichi ..... H01Q 5/371 343/702
2003/0020656 A1 1/2003 Shor
2005/0280579 A1* 12/2005 Liang ..... H01Q 21/29 343/700 MS

FOREIGN PATENT DOCUMENTS

CN 204516895 U * 7/2015
KR 100785726 B1 * 12/2007
TW 565967 B 12/2003

* cited by examiner

*Primary Examiner* — Dieu Hien T Duong
(74) *Attorney, Agent, or Firm* — McClure, Qualey & Rodack, LLP

(57) ABSTRACT

A dipole antenna includes a first conductor, a second conductor, a first radiation element, and a second radiation element. The first conductor has a first feeding point. The second conductor has a second feeding point. The first radiation element is coupled to the first conductor. The second radiation element is coupled to the second conductor. The dipole antenna covers an operation frequency band. The first radiation element at least includes a first meandering structure. The first meandering structure is configured to suppress the frequency multiplication resonance with respect to the operation frequency band.

18 Claims, 5 Drawing Sheets

DIPOLE ANTENNA

CROSS REFERENCE TO RELATED APPLICATIONS

This application claims priority of Taiwan Patent Application No. 109112933 filed on Apr. 17, 2020, the entirety of which is incorporated by reference herein.

BACKGROUND OF THE INVENTION

Field of the Invention

The disclosure generally relates to a dipole antenna, and more particularly, it relates to a dipole antenna for suppressing frequency multiplication resonance.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements in mobile devices as they support wireless communication. However, if an antenna has a relatively large bandwidth, it may cause unwanted frequency multiplication resonance, and the radiation efficiency of the corresponding specific frequency may be poor. Accordingly, there is a need to propose a novel solution for solving the problems of the prior art.

BRIEF SUMMARY OF THE INVENTION

In an exemplary embodiment, the disclosure is directed to a dipole antenna that includes a first conductor, a second conductor, a first radiation element, and a second radiation element. The first conductor has a first feeding point. The second conductor has a second feeding point. The first radiation element is coupled to the first conductor. The second radiation element is coupled to the second conductor. The dipole antenna covers an operation frequency band. The first radiation element at least includes a first meandering structure. The first meandering structure is configured to suppress the frequency multiplication resonance with respect to the operation frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
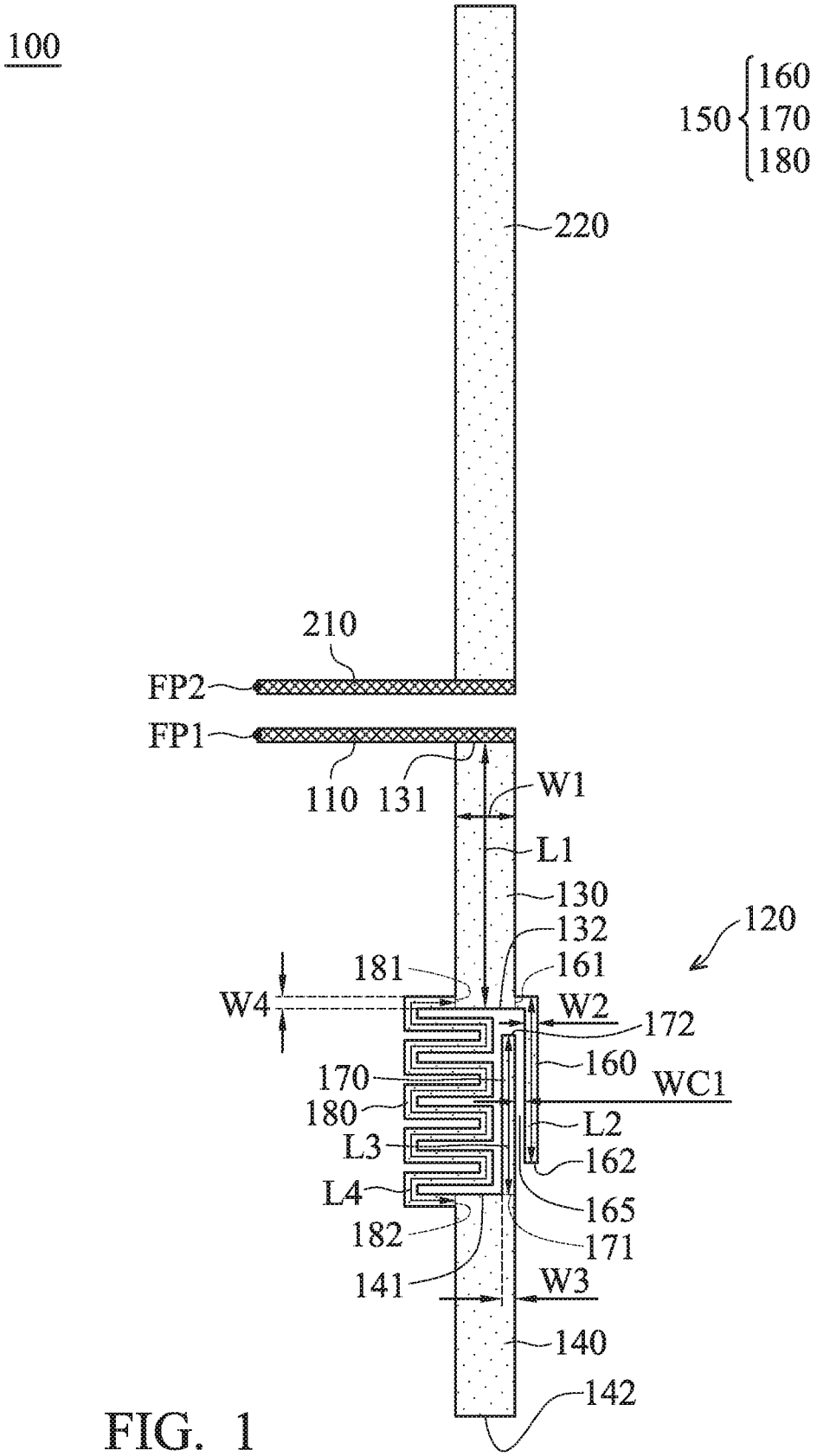
FIG. 1 is a diagram of a dipole antenna according to an embodiment of the invention.

FIG. 1 is a diagram of a dipole antenna 100 according to an embodiment of the invention. The dipole antenna 100 may be applied to a mobile device, such as a smart phone, a tablet computer, or a notebook computer. As shown in FIG. 1, the dipole antenna 100 includes a first conductor 110, a second conductor 210, a first radiation element 120, and a second radiation element 220. The above elements of the dipole antenna 100 may all be made of metal materials, such as copper, silver, aluminum, iron, or their alloys.

The first conductor 110 has a first feeding point FP1. The second conductor 210 has a second feeding point FP2. For example, the first feeding point FP1 may be coupled to a positive electrode of a signal source (not shown), and the second feeding point FP2 may be coupled to a negative electrode of the signal source. Alternatively, the first feeding point FP1 may be coupled to the negative electrode of the signal source, and the second feeding point FP2 may be coupled to the positive electrode of the signal source. The signal source may be an RF (Radio Frequency) module for exciting the dipole antenna 100. In some embodiments, a transmission line is formed by the first conductor 110 and the second conductor 210 together, and its type is not limited in the invention.

The first radiation element 120 is coupled to the first conductor 110. The second radiation element 220 is coupled to the second conductor 210. The second radiation element 220 may substantially have a straight-line shape. The dipole antenna 100 can cover an operation frequency band. For example, the aforementioned frequency band may include frequency intervals from 2400 MHz to 2500 MHz and further from 5150 MHz to 5850 MHz, such that the dipole antenna 100 can support the dual-band operations of WLAN (Wireless Local Area Networks) 2.4 GHz/5 GHz. It should be noted that the first radiation element 120 at least includes a first meandering structure 150. The first meandering structure 150 is configured to suppress the frequency multiplication resonance with respect to the operation frequency band, thereby increasing the radiation efficiency of the dipole antenna 100.

In some embodiments, the first conductor 110, the second conductor 210, the first radiation element 120, and the second radiation element 220 are formed on the same surface of a dielectric substrate (not shown). It is unnecessary to use any SMT (Surface Mount Technology) and SMD (Surface Mount Device), thereby reducing the whole complexity and whole manufacturing cost.

In addition to the first meandering structure 150, the first radiation element 120 may further include a first segment 130 and a second segment 140. Each of the first segment 130 and the second segment 140 may substantially have a straight-line shape. The first segment 130 has a first end 131 and a second end 132. The first end 131 of the first segment 130 is coupled to the first conductor 110. The second segment 140 has a first end 141 and a second end 142. The second end 142 of the second segment 140 is an open end. The first meandering structure 150 is coupled between the second end 132 of the first segment 130 and the first end 141 of the second segment 140.

Specifically, the first meandering structure 150 includes a first branch 160, a second branch 170, and a third branch 180. Each of the first branch 160 and the second branch 170 may substantially have a straight-line shape. The first branch 160 has a first end 161 and a second end 162. The first end 161 of the first branch 160 is coupled to a corner of the second end 132 of the first segment 130. The second end 162 of the first branch 160 is an open end. The second branch 170 has a first end 171 and a second end 172. The first end 171 of the second branch 170 is coupled to a corner of the first end 141 of the second segment 140. The second end 172 of the second branch 170 is an open end. The second end 162 of the first branch 160 and the second end 172 of the second branch 170 may substantially extend in opposite directions. The first branch 160 and the second branch 170 may be substantially parallel to each other. A coupling gap 165 may be formed between the first branch 160 and the second branch 170. The third branch 180 may be substantially a combination of a plurality of W-shapes. The third branch 180 has a first end 181 and a second end 182. The first end 181 of the third branch 180 is coupled to another corner of the second end 132 of the first segment 130. The second end 182 of the third branch 180 is coupled to another corner of the first end 141 of the second segment 140.

In some embodiments, the element sizes of the first radiation element 120 are described as the following equations (1) to (8):

$$L1 = \frac{1}{8} \cdot \lambda \cdot k \tag{1}$$

$$L2 = \frac{1}{12} \cdot \lambda \cdot k \tag{2}$$

$$L3 = \frac{1}{12} \cdot \lambda \cdot k \tag{3}$$

$$L4 = \frac{1}{5} \cdot \lambda \cdot k \tag{4}$$

$$WC1 < \frac{1}{165} \cdot \lambda \tag{5}$$

$$W1 > W2 = W3 = W4 \tag{6}$$

-continued $$W2 = W3 = W4 < \frac{1}{165} \cdot \lambda \tag{7}$$

$$\lambda = \frac{c}{f} \tag{8}$$

where "L1" represents the length L1 of the first segment 130, "W1" represents the width W1 of the first segment 130, "L2" represents the length L2 of the first branch 160, "W2" represents the width W2 of the first branch 160, "L3" represents the length L3 of the second branch 170, "W3" represents the width W3 of the second branch 170, "L4" represents the length L4 of the third branch 180, "W4" represents the width W4 of the third branch 180, "WC1" represents the width WC1 of the coupling gap 165, "λ" represents the wavelength of a target frequency f of the operation frequency band of the dipole antenna 100, "k" represents an error coefficient from 0.8 to 1.2, and "c" represents the speed of light.

For example, if it is required to suppress the frequency multiplication resonance within a frequency interval from 5150 MHz to 5850 MHz, the aforementioned target frequency f may be set to an average value of the frequency interval, i.e., 5500 MHz. The error coefficient k is adjustable in response to different environmental conditions. If the dielectric substrate is selected as an FR4 (Flame Retardant 4) substrate with a thickness of about 0.8 mm, the error coefficient k may be substantially equal to 1. According to practical measurements, the incorporation of the first meandering structure 150 can adjust the effective resonant length of the first radiation element 120. For the target frequency f, its main current path is limited within the first segment 130 of the first radiation element 120 (without extending beyond the first meandering structure 150), such that the radiation efficiency of the target frequency f is significantly improved. The above ranges of element sizes are calculated and obtained according to many experiment results, and they help to optimize the radiation efficiency and impedance matching of the dipole antenna 100.

Figure 2:
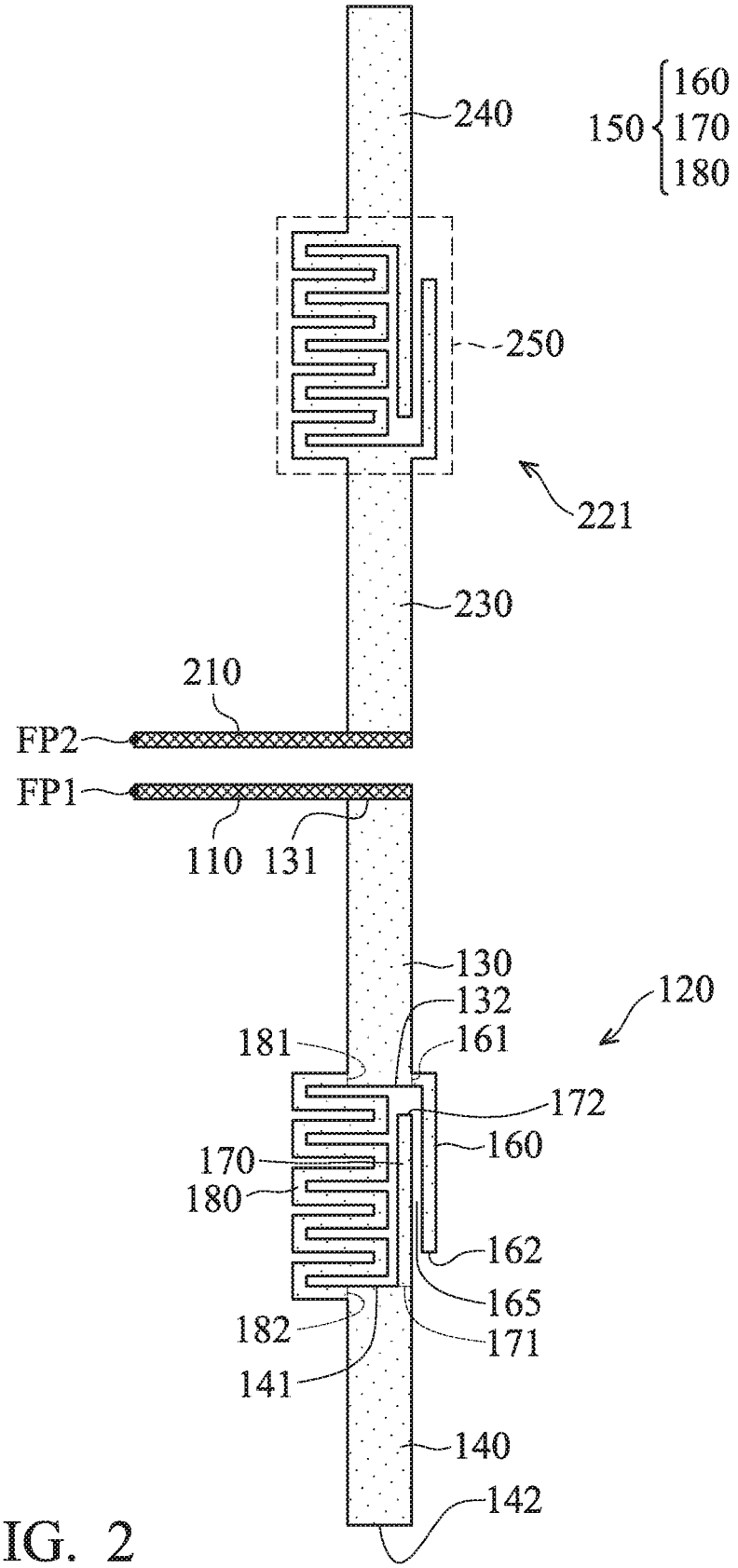
FIG. 2 is a diagram of a dipole antenna according to another embodiment of the invention.

FIG. 2 is a diagram of a dipole antenna 200 according to another embodiment of the invention. FIG. 2 is similar to FIG. 1. In the embodiment of FIG. 2, a second radiation element 221 of the dipole antenna 200 includes a third segment 230, a fourth segment 240, and a second meandering structure 250. The third segment 230 is coupled to the second conductor 210. The second meandering structure 250 is coupled between the third segment 230 and the fourth segment 240. The second radiation element 221 and the second meandering structure 250 thereof may be mirror-symmetrical with respect to the first radiation element 120 and the first meandering structure 150 thereof. According to practical measurements, the incorporation of the second meandering structure 250 can further increase the radiation efficiency of the dipole antenna 200. Other features of the dipole antenna 200 of FIG. 2 are similar to those of the dipole antenna 100 of FIG. 1. Accordingly, the two embodiments can achieve similar levels of performance.

Figure 3:
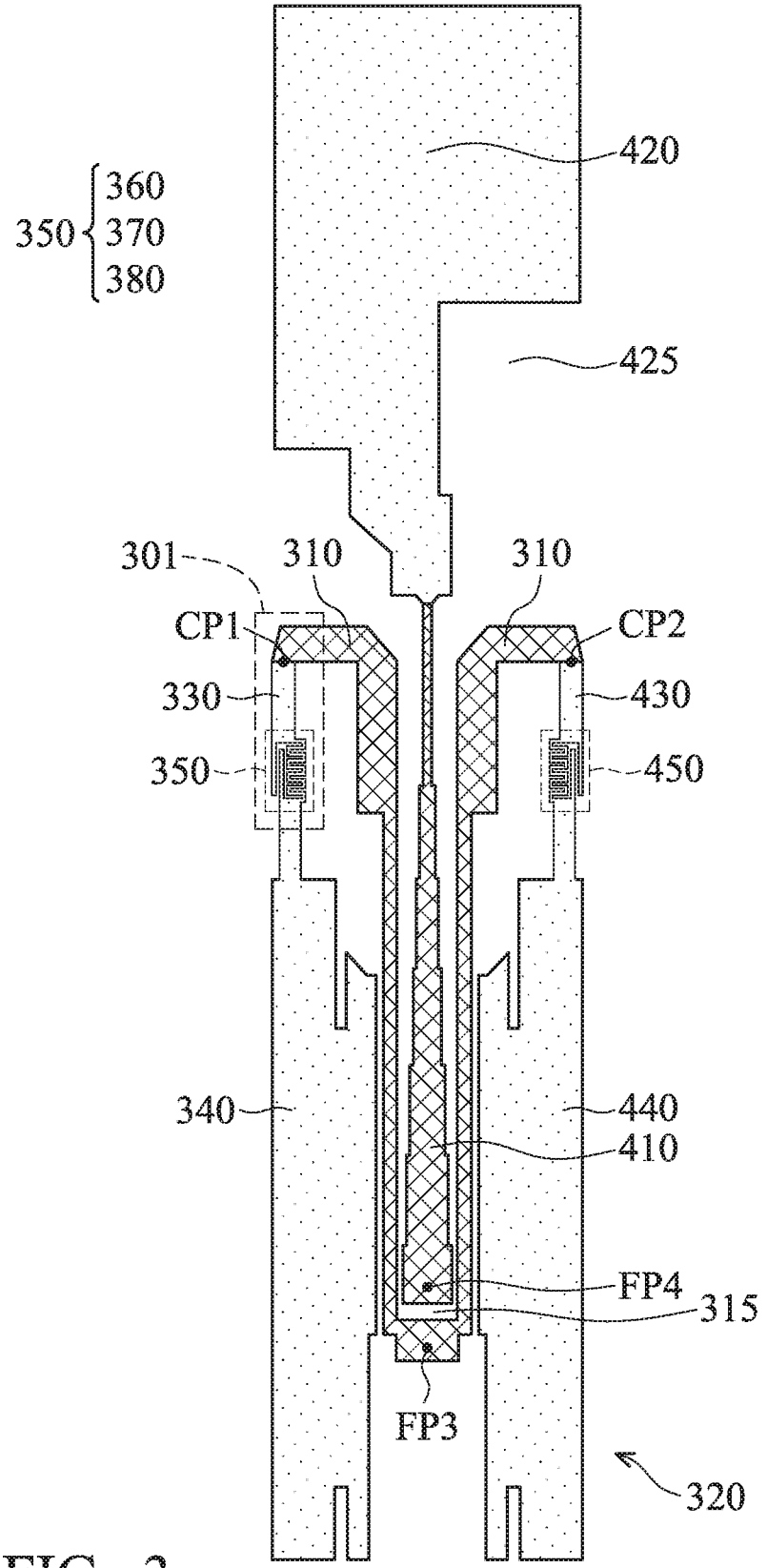
FIG. 3 is a diagram of a dipole antenna according to another embodiment of the invention.
Figure 4:
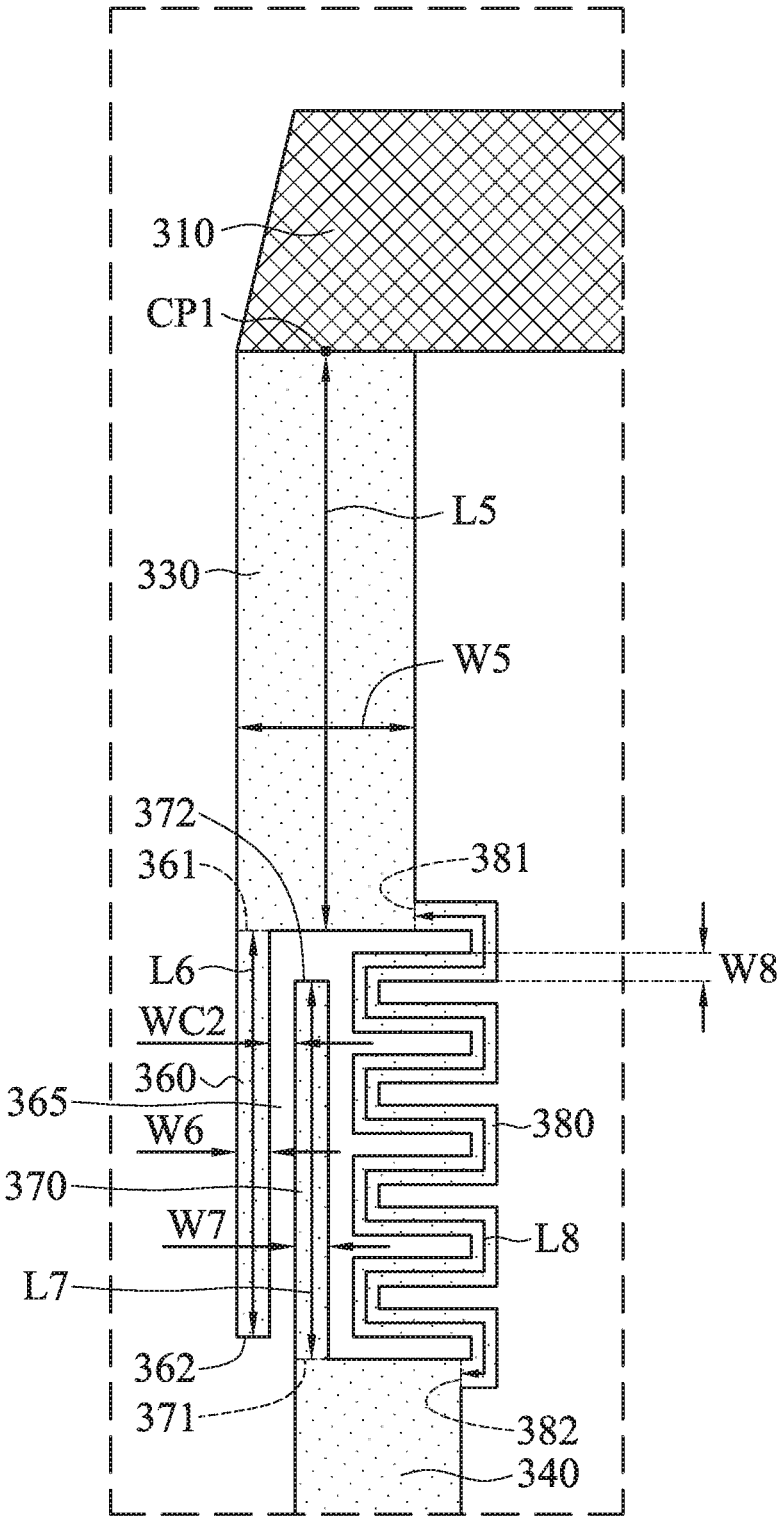
FIG. 4 is a partial enlarged view of a dashed-box of a dipole antenna according to another embodiment of the invention.

FIG. 3 is a diagram of a dipole antenna 300 according to another embodiment of the invention. FIG. 4 is a partial enlarged view of a dashed-box 301 of the dipole antenna 300 according to another embodiment of the invention. Please refer to FIG. 3 and FIG. 4 together. In the embodiment of FIG. 3 and FIG. 4, the dipole antenna 300 includes a first conductor 310, a second conductor 410, a first radiation element 320, and a second radiation element 420. The above elements of the dipole antenna 300 may all be made of metal materials.

The first conductor 310 has a first feeding point FP3. The second conductor 410 has a second feeding point FP4. In some embodiments, a transmission line is formed by the first conductor 310 and the second conductor 410. For example, the first conductor 310 may substantially have a V-shape, and the second conductor 410 may substantially have a straight-line shape extending into a notch 315 of the first conductor 310. In addition, each of the first conductor 310 and the second conductor 410 may have a variable-width structure for fine-tuning the impedance matching of the dipole antenna 300.

The first radiation element 320 is coupled to the first conductor 310. The second radiation element 420 is coupled to the second conductor 410. The first radiation element 320 may be a symmetrical pattern, and the second radiation element 420 may be an asymmetrical pattern. For example, the second radiation element 420 may have a rectangular corner notch 425. The dipole antenna 300 can cover an operation frequency band. For example, the aforementioned frequency band may from 617 MHz to 7125 MHz, such that the dipole antenna 300 can support the wideband operations of sub-6 GHz. It should be noted that the first radiation element 320 includes a first meandering structure 350 and a second meandering structure 450. Both of the first meandering structure 350 and the second meandering structure 450 are configured to suppress the frequency multiplication resonance with respect to the operation frequency band, thereby increasing the radiation efficiency of the dipole antenna 300.

In some embodiments, the first conductor 310, the second conductor 410, the first radiation element 320, and the second radiation element 420 are formed on the same surface of a dielectric substrate (not shown). It is unnecessary to use any SMT and SMD, thereby reducing the whole complexity and whole manufacturing cost.

In addition to the first meandering structure 350 and the second meandering structure 450, the first radiation element 320 further includes a first segment 330, a second segment 340, a third segment 430, and a fourth segment 440. The first segment 330 is coupled to a first connection point CP1 on the first conductor 310. The third segment 430 is coupled to a second connection point CP2 on the first conductor 310 (the second connection point CP2 may be different from the first connection point CP1). The first meandering structure 350 is coupled between the first segment 330 and the second segment 340. The second meandering structure 450 is coupled between the third segment 430 and the fourth segment 440. The first segment 330 may substantially have a straight-line shape. The second segment 340 may have an irregular shape. The length and the width of the second segment 340 may be much greater than the length and the width of the first segment 330. The third segment 430 may substantially have a straight-line shape. The fourth segment 440 may have an irregular shape. The length and the width of the fourth segment 440 may be much greater than the length and the width of the third segment 430. Since the second meandering structure 450 is mirror-symmetrical with respect to the first meandering structure 350, the following embodiments will merely illustrate the first meandering structure 350 as an example.

As shown in FIG. 4, the first meandering structure 350 includes a first branch 360, a second branch 370, and a third branch 380. Each of the first branch 360 and the second branch 370 may substantially have a straight-line shape. The first branch 360 has a first end 361 and a second end 362. The first end 361 of the first branch 360 is coupled to a corner of the first segment 330. The second end 362 of the first branch 360 is an open end. The second branch 370 has a first end 371 and a second end 372. The first end 371 of the second branch 370 is coupled to a corner of the second segment 340. The second end 372 of the second branch 370 is an open end. The second end 362 of the first branch 360 and the second end 372 of the second branch 370 may substantially extend in opposite directions. The first branch 360 and the second branch 370 may be substantially parallel to each other. A coupling gap 365 may be formed between the first branch 360 and the second branch 370. The third branch 380 may be substantially a combination of a plurality of W-shapes. The third branch 380 has a first end 381 and a second end 382. The first end 381 of the third branch 380 is coupled to another corner of the first segment 330. The second end 382 of the third branch 380 is coupled to another corner of the second segment 340.

In some embodiments, the element sizes of the first radiation element 320 are described as the following equations (9) to (16):

$$L5 = \frac{1}{8} \cdot \lambda \cdot k \tag{9}$$

$$L6 = \frac{1}{12} \cdot \lambda \cdot k \tag{10}$$

$$L7 = \frac{1}{12} \cdot \lambda \cdot k \tag{11}$$

$$L8 = \frac{1}{5} \cdot \lambda \cdot k \tag{12}$$

$$WC2 < \frac{1}{165} \cdot \lambda \tag{13}$$

$$W5 > W6 = W7 = W8 \tag{14}$$

$$W6 = W7 = W8 < \frac{1}{165} \cdot \lambda \tag{15}$$

$$\lambda = \frac{c}{f} \tag{16}$$

where "L5" represents the length L5 of the first segment 330, "W5" represents the width W5 of the first segment 330, "L6" represents the length L6 of the first branch 360, "W6" represents the width W6 of the first branch 360, "L7" represents the length L7 of the second branch 370, "W7" represents the width W7 of the second branch 370, "L8" represents the length L8 of the third branch 380, "W8" represents the width W8 of the third branch 380, "WC2" represents the width WC2 of the coupling gap 365, "λ" represents the wavelength of a target frequency f of the operation frequency band of the dipole antenna 300, "k" represents an error coefficient from 0.8 to 1.2, and "c" represents the speed of light.

For example, if it is required to suppress the frequency multiplication resonance within a frequency interval from 5150 MHz to 7125 MHz, the aforementioned target frequency f may be set to an average value of the frequency interval, i.e., 6100 MHz. If the dielectric substrate is selected as an FR4 substrate with a thickness of about 0.8 mm, the error coefficient k may be substantially equal to 1. According to practical measurements, the incorporation of the first meandering structure 350 and the second meandering structure 450 can adjust the effective resonant length of the first radiation element 320. For the target frequency f, its main current path is limited within the first segment 330 and the third segment 430 of the first radiation element 320 (without extending beyond the first meandering structure 350 and the second meandering structure 450), such that the radiation efficiency of the target frequency f is significantly improved. The above ranges of element sizes are calculated and obtained according to many experiment results, and they help to optimize the radiation efficiency and impedance matching of the dipole antenna 300. Other features of the dipole antenna 300 of FIG. 3 and FIG. 4 are similar to those of the dipole antenna 100 of FIG. 1. Accordingly, the two embodiments can achieve similar levels of performance.

Figure 5:
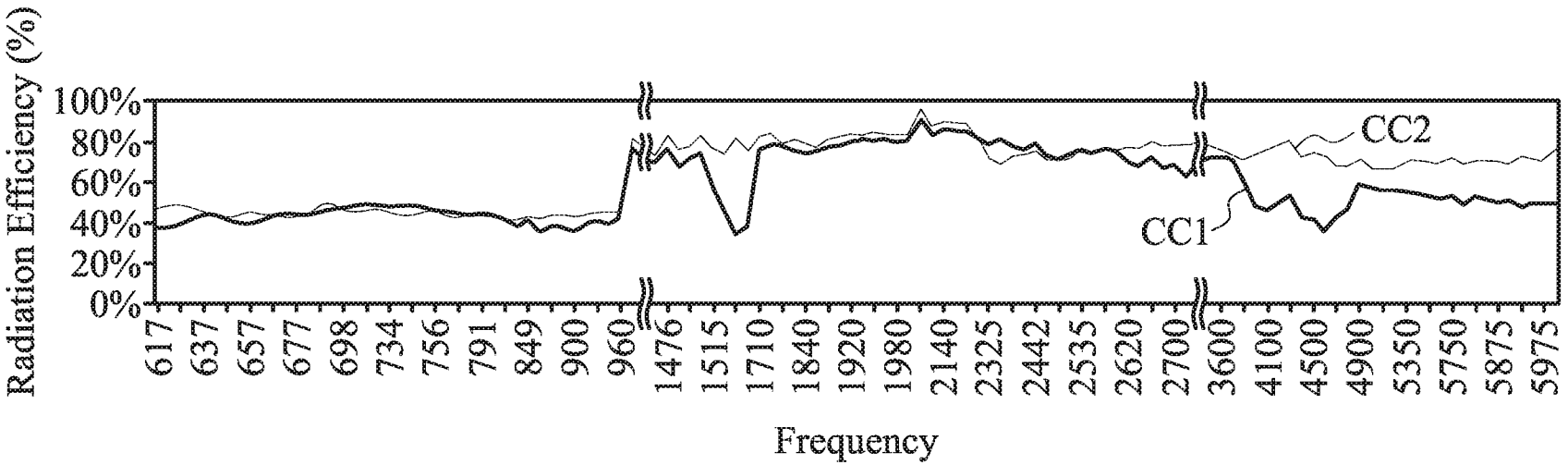
FIG. 5 is a diagram of radiation efficiency of a dipole antenna according to another embodiment of the invention.

FIG. 5 is a diagram of radiation efficiency of the dipole antenna 300 according to another embodiment of the invention. As shown in FIG. 5, a first curve CC1 represents the radiation efficiency of the dipole antenna 300 when the first meandering structure 350 and the second meandering structure 450 have not been included, and a second curve CC2 represents the radiation efficiency of the dipole antenna 300 when the first meandering structure 350 and the second meandering structure 450 have been included. According to the measurement of FIG. 5, after the first meandering structure 350 and the second meandering structure 450 are incorporated, the radiation efficiency of the dipole antenna 300 is effective increased at 2 times (e.g., about 1575 MHz) and 10 times (e.g., about 6100 MHz) of its lowest frequency band.

The invention proposes a novel dipole antenna which includes at least one meandering structure for suppressing frequency multiplication resonance with respect to its operation frequency band. Generally, the invention has at least the advantages of small size, wide bandwidth, high radiation efficiency, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the dipole antenna of the invention is not limited to the configurations of FIGS. 1-5. The invention may merely include any one or more features of any one or more embodiments of FIGS. 1-5. In other words, not all of the features displayed in the figures should be implemented in the dipole antenna of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dipole antenna, comprising:

a first conductor, having a first feeding point;

a second conductor, having a second feeding point;

a first radiation element, coupled to the first conductor; and a second radiation element, coupled to the second conductor;

wherein the dipole antenna covers an operation frequency band;

wherein the first radiation element at least comprises a first meandering structure, and the first meandering structure is configured to suppress frequency multiplication resonance with respect to the operation frequency band;

wherein the second radiation element has a rectangular corner notch;

wherein the first radiation element is a symmetrical pattern, and the second radiation element is an asymmetrical pattern.

2. The dipole antenna as claimed in claim 1, wherein the operation frequency band comprises frequency intervals from 2400 MHz to 2500 MHz and further from 5150 MHz to 5850 MHz.

3. The dipole antenna as claimed in claim 1, wherein the first radiation element further comprises a first segment and a second segment, the first segment is coupled to the first conductor, and the first meandering structure is coupled between the first segment and the second segment.

4. The dipole antenna as claimed in claim 3, wherein the first meandering structure comprises:

a first branch, coupled to the first segment;

a second branch, coupled to the second segment, wherein the first branch and the second branch substantially extend in opposite directions; and a third branch, coupled between the first branch and the second branch.

5. The dipole antenna as claimed in claim 4, wherein each of the first branch and the second branch substantially has a straight-line shape.

6. The dipole antenna as claimed in claim 4, wherein a coupling gap is formed between the first branch and the second branch.

7. The dipole antenna as claimed in claim 6, wherein a width of the coupling gap is determined as follows:

$$WC1 < \frac{1}{165} \cdot \lambda$$

where "WC1" represents the width of the coupling gap, and "λ" represents a wavelength of a target frequency of the operation frequency band.

8. The dipole antenna as claimed in claim 4, wherein the third branch comprises a plurality of W-shapes.

9. The dipole antenna as claimed in claim 4, wherein a length of the first segment is determined as follows:

$$L1 = \frac{1}{8} \cdot \lambda \cdot k$$

where "L1" represents the length of the first segment, "λ" represents a wavelength of a target frequency of the operation frequency band, and "k" represents an error coefficient from 0.8 to 1.2.

10. The dipole antenna as claimed in claim 4, wherein a length of the first branch is determined as follows:

$$L2 = \frac{1}{12} \cdot \lambda \cdot k$$

where "L2" represents the length of the first branch, "λ" represents a wavelength of a target frequency of the operation frequency band, and "k" represents an error coefficient from 0.8 to 1.2.

11. The dipole antenna as claimed in claim 4, wherein a length of the second branch is determined as follows:

$$L3 = \frac{1}{12} \cdot \lambda \cdot k$$

where "L3" represents the length of the second branch, "λ" represents a wavelength of a target frequency of the operation frequency band, and "k" represents an error coefficient from 0.8 to 1.2.

12. The dipole antenna as claimed in claim 4, wherein a length of the third branch is determined as follows:

$$L4 = \frac{1}{5} \cdot \lambda \cdot k$$

where "L4" represents the length of the third branch, "λ" represents a wavelength of a target frequency of the operation frequency band, and "k" represents an error coefficient from 0.8 to 1.2.

13. The dipole antenna as claimed in claim 1, wherein the second radiation element comprises a third segment, a fourth segment, and a second meandering structure, the third segment is coupled to the second conductor, and the second meandering structure is coupled between the third segment and the fourth segment.

14. The dipole antenna as claimed in claim 1, wherein the operation frequency band is from 617 MHz to 7125 MHz.

15. The dipole antenna as claimed in claim 1, wherein the first conductor substantially has a V-shape, and the second conductor substantially has a straight-line shape extending into a notch of the first conductor.

16. The dipole antenna as claimed in claim 1, wherein the first radiation element further comprises a second meandering structure.

17. The dipole antenna as claimed in claim 16, wherein the first radiation element further comprises a first segment, a second segment, a third segment, and a fourth segment, the first segment is coupled to a first connection point on the first conductor, the third segment is coupled to a second connection point on the first conductor, the first meandering structure is coupled between the first segment and the second segment, and the second meandering structure is coupled between the third segment and the fourth segment.

18. The dipole antenna as claimed in claim 17, wherein a length and a width of the second segment are much greater than those of the first segment, and a length and a width of the fourth segment are much greater than those of the third segment.

* * * * *